US005255541A

United States Patent [19]

Porter et al.

[11] Patent Number: 5,255,541

[45] Date of Patent: Oct. 26, 1993

[54] COLLAR LAUNDERING MACHINE

[76] Inventors: Ernest A. Porter, 900 Rio St. Johns Dr., Jacksonville, Fla. 92211; Michael T. Porter, 10941 Putney Ct., Jacksonville, Fla. 32225

[21] Appl. No.: 907,504

[22] Filed: Jul. 1, 1992

[51] Int. Cl.[5] ..... D06B 1/02

[52] U.S. Cl. ..... 68/205 R; 68/240

[58] Field of Search ..... 68/205 R, 240; 134/144, 134/172, 174; 118/323

[56] References Cited

U.S. PATENT DOCUMENTS

| | | | |
|---|---|---|---|
| 883,132 | 3/1908 | Goff | 134/172 X |
| 1,111,445 | 9/1914 | Dunton | 134/172 X |
| 1,614,408 | 1/1927 | Stoffel | 68/205 R X |
| 4,120,180 | 10/1978 | Jedora | 68/205 R X |
| 4,952,325 | 8/1990 | Clifford | 134/144 X |

FOREIGN PATENT DOCUMENTS

| | | | |
|---|---|---|---|
| 0401472 | 12/1990 | European Pat. Off. | 68/205 R |
| 504866 | 8/1930 | Fed. Rep. of Germany | 134/144 |
| 2407843 | 9/1975 | Fed. Rep. of Germany | 118/323 |
| 913326 | 5/1946 | France | 134/172 |
| 159888 | 4/1983 | German Democratic Rep. | 68/240 |
| 16270 | 5/1971 | Japan | 118/323 |
| 132930 | 10/1919 | United Kingdom | 134/172 |

*Primary Examiner*—Philip R. Coe

*Attorney, Agent, or Firm*—Arthur G. Yeager

[57] ABSTRACT

A machine for directing a high pressure reciprocating spray of cleaning liquid against a shirt collar; comprising a frame, a work table, reciprocating spray suspended above, and pointing downwardly at the work table, a reservoir of cleaning liquid, a pump to supply the cleaning liquid to the nozzle at high pressure, and a means to move the spray in a reciprocating manner.

9 Claims, 3 Drawing Sheets

COLLAR LAUNDERING MACHINE

BACKGROUND OF THE INVENTION

Laundries must frequently apply extra effort to clean portions of clothes that are heavily soiled. A typical example is a shirt collar. Normally, a shirt collar is scrubbed by hand with a brush and concentrated cleaning liquid, e.g., detergent dissolved in water, in order to clean the collar properly. This operation precedes the normal washing, drying and pressing of the shirt. This is an expensive, time-consuming procedure, which has not been eliminated by any known machinery of the prior art.

It is an object of this invention to provide a machine for cleaning shirt collars or other small areas of clothing. It is another object to provide such a machine employing a reciprocating spray of high pressure liquid. Still other objects will become apparent from the detailed description which follows.

BRIEF SUMMARY OF THE INVENTION

This invention relates to an apparatus for laundry spraycleaning comprising a housing containing a horizontally positioned open-top tub containing a reservoir of cleaning liquid, a horizontal work table above said tub, a spray nozzle suspended above said work table and directed to spray said liquid downwardly against said work table while moving in a horizontal reciprocating motion across said work table, a pump to receive said liquid from said tub, pressurize it and deliver the pressurized liquid to said nozzle, and means to selectively cause said spray nozzle to reciprocate.

In specific and preferred embodiments of the invention the nozzle is suspended rigidly from a sliding block that is moved in a reciprocating manner by the action of a piston in a cylinder of pressurized fluid.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
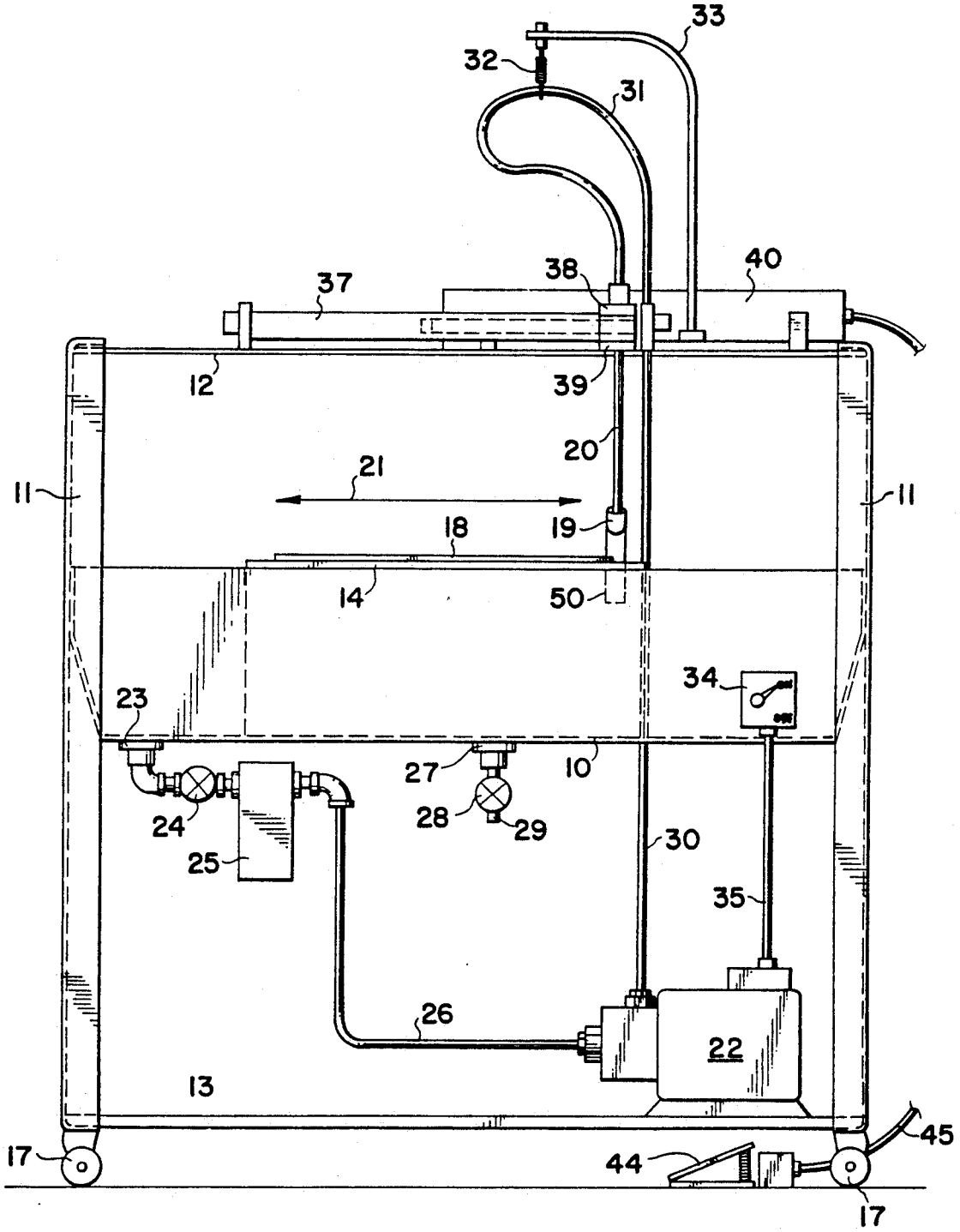
FIG. 1 is a front elevational view of the apparatus of this invention.
Figure 2:
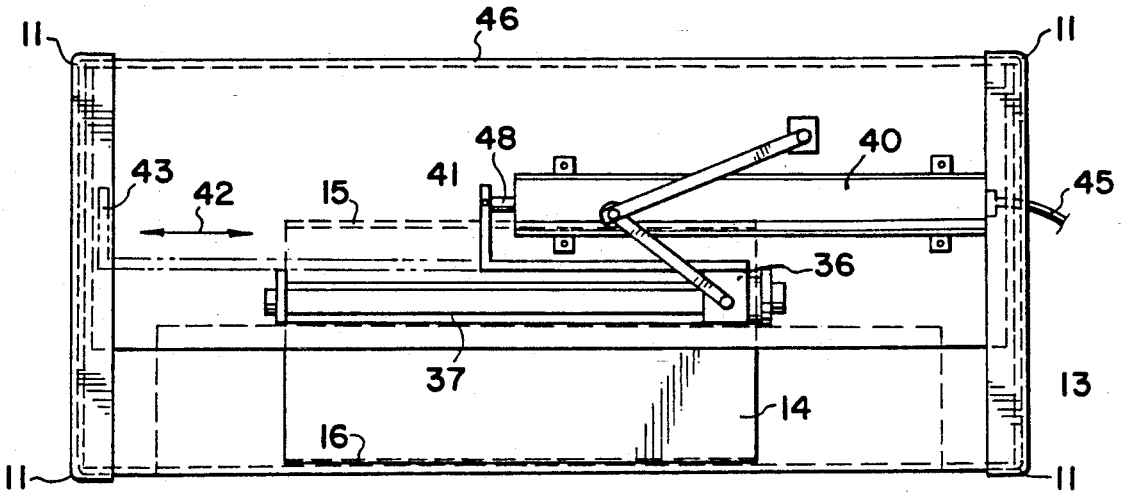
FIG. 2 is a top plan view of the apparatus of this invention.

The operating features of this invention are best given below with reference to the attached drawings.

The apparatus of this invention is contained in a housing which may take on any of many configurations, but which is shown here in a simplified form consisting of two vertical panels 11, with a horizontal bottom plate 13, a back panel 46, and a horizontal top plate 12 bolted to panels 11. Because this apparatus produces a substantial amount of splashing of the cleaning liquid, it is preferable for panels 11 and 46 and plate 12 to be of solid material, such as composite fiberglass/plastic to contain the splashing liquid inside the housing. Other possible panel locations are across the front to protect the operator, and around all sides of the lower part of the housing to protect the pump and other machinery and equipment from dust and dirt.

In the central portion of the housing is a sink or tub 10 which holds a reservoir of the cleaning liquid. Normally the cleaning liquid will be an aqueous solution of a degreasing detergent such as that used to clean automobile engines. There may be other additives in the cleaning liquid to help remove stains, to soften the water, or provide other enhancements. Furthermore, this apparatus may be used with dry cleaning liquid to perform its cleaning operations. After the collar cleaning operation in this apparatus the shirt would then be subjected to the normal washing, drying and pressing operations of a commercial laundry.

A work table 14 extends from the front of the tub to a position generally over the center of tub 10 at an elevation substantially the same as the open top of tub 10. On the work table 14 is laid the clothing part 18 (e.g., a shirt collar) which is to be cleaned. Thus, the area dimensions and shape of work table 14 may vary depending on the job to be done. As a shirt collar cleaning machine, work table is generally a flat rectangular plate of plastic, stainless steel, or porcelain coated steel, about 12×24 inches in size. Work table 14 is rigidly supported in or above tub 10 by any suitable means, such as legs or braces 15 and 16.

Suspended above work table 14 is a nozzle 19 on the lower end of a pipe 20 with nozzle 19 about 2–3 inches above work table 14. Nozzle 19 and pipe 20 are supported by a mechanism which permits the nozzle 19 to move reciprocatingly in the direction of arrow 21 and then return to the position shown in FIG. 1. The length of travel is dictated by the clothing to be cleaned. In the case of a shirt collar 18 the length of travel is about 18 inches. The mechanism to provide this reciprocating travel will be described below.

The working operation is accomplished by directing a spray of high pressure, medium spray drop size, cleaning liquid against the soiled areas of clothing on work table 14. The cleaning liquid is held in tub 10, delivered to nozzle 19 and collected again in tub 10 in a recycle operation. Liquid from tub 10 passes through drain fitting 23 and valve 24 to lint filter 25, where lint is removed from the liquid and the lint-free liquid is fed into the suction side of pump 22 and delivered at a high pressure, e.g., 500–2000 p.s.i.g. preferably about 800–1500 p.s.i.g. to conduit 30 which directs the pressurized liquid to nozzle 19 having a spray angle of about 30°–60°, preferably 40°. Pump 22 delivers about 1.5–2.0 gal. per minute, preferably about 1.8 gal. per minute, and is driven by commercial electric power entering the apparatus through switch 34 which selectively turns the power on or off to the pump 22, with wiring being carried in conduit 35. Tub 10 is also fitted with a drain connection to remove liquid from tub 10 as desired. Drain fitting 27, valve 28, and exit pipe 29 provide that drainage feature.

In order to connect the rigid delivery pipe 30 to a movable nozzle 19 there is a section of flexible rubber hose 31 supported by a spring 32 hanging from a support stand 33 extending upwardly from top plate 13.

Figure 4:
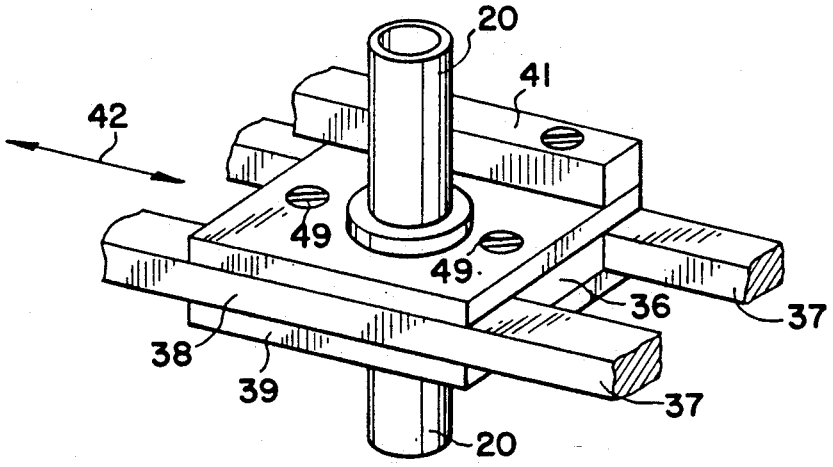
FIG. 4 is an enlarged perspective view of the sliding block assembly for moving the nozzle in a reciprocating manner.
Figure 3:
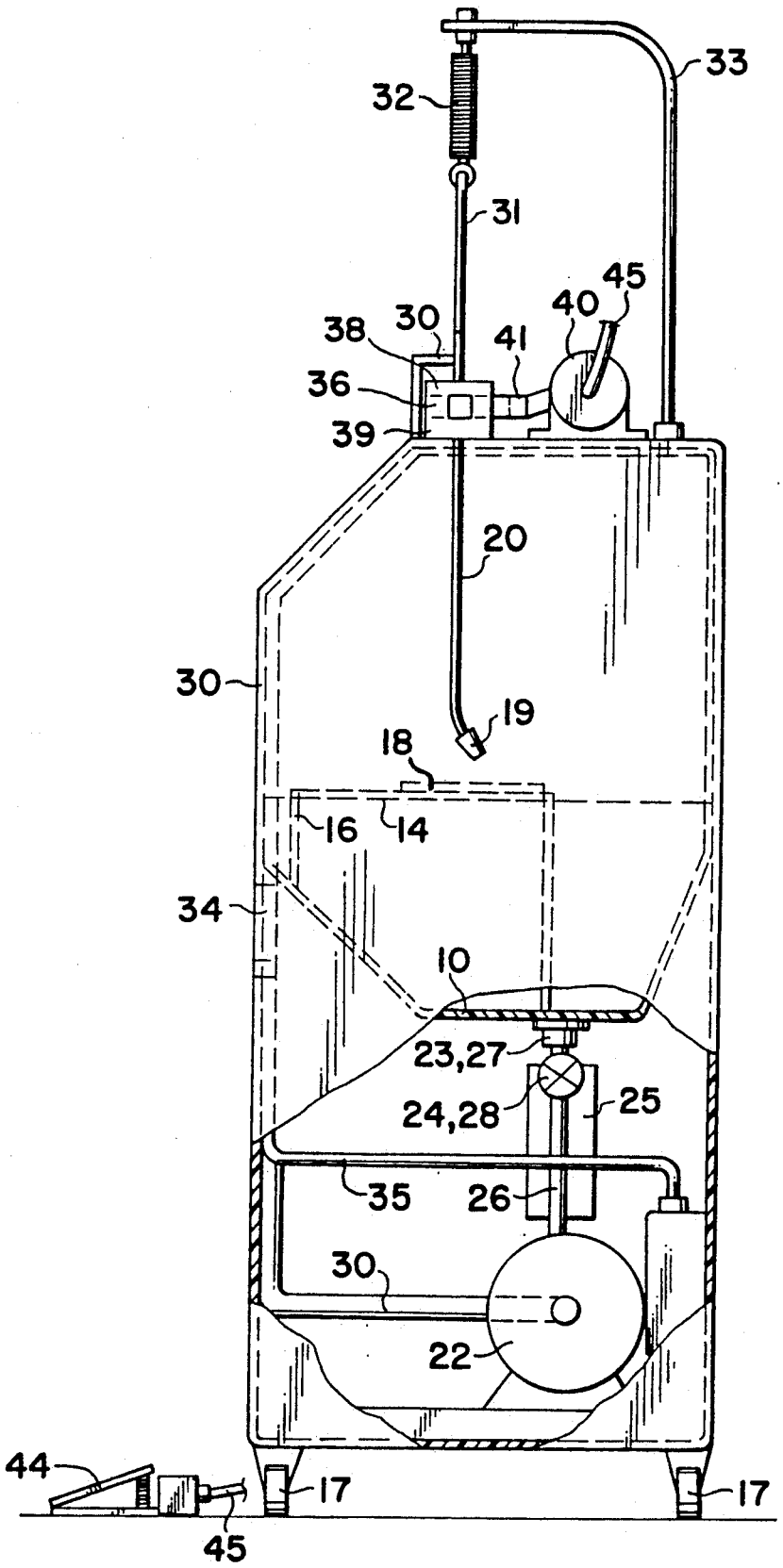
FIG. 3 is a side elevational view of the apparatus of this invention.

The mechanism for moving nozzle 19 in a reciprocating manner comprises a sliding block 36 mounted on a track 37 and moved by the action of a pressurized fluid cylinder 40. Fluid cylinder 40 may be hydraulic or pneumatic and with an internal piston moving inside the cylinder in accordance with the pressure differential on both sides of the piston. A piston rod 48 connected to the piston extends outwardly of one end of the cylinder to provide movement to whatever is attached to piston rod 48. In this instance arm 41 is connected at one end to piston rod 48 and at the other end to sliding block assembly 36 so that as piston rod 48 moves so does block 36. The assembly of block 36 can best be seen in FIG. 4. Nozzle pipe 20 is rigidly attached to and passes completely through a sandwich of top member 38, central sliding block 36, and bottom member 39 which are fastened together by screws 49. Track 37 consists of two spaced parallel bars with block 36 sliding between those bars, top-member 38 sliding on top of those bars, and bottom member 39 sliding beneath those bars. Arm 41 is attached to top member 38 by screws or bolts. As cylinder 40 is pressurized, piston rod 48 is moved causing arm 41 to move, which in turn caused block 36 and members 38 and 39 to move, and thereby moving pipe 20 to which nozzle 19 is affixed. A preferred method of controlling the movement of nozzle 19 is to employ a foot pedal 44 electrically connected through line 45 to cylinder 40. The control may be merely to trigger one complete cycle of movement following arrow 21 (FIG. 1) or it may be a start and stop movement allowing continuous movement when the pedal is depressed and stopping when the pedal is not depressed.

The pumping action may also be controlled in a start and stop operation but preferably runs continuously so as to eliminate the wear and tear of starting and stopping an electric motor. If the nozzle 19 in its beginning position discharges directly into tub 10 and not against work table 14, there is no need for splash protection. If, however, the nozzle 19 stops above work table 14, it is preferred to employ a pipe guard 50 as shown in dotted lines in FIG. 1 which surrounds nozzle 19 and directs the spray downwardly inside of pipe 50 while the cleaned collar 18 is removed, and another soiled collar is placed on the work table 14 for the next cleaning cycle of nozzle 19 moving through directions 21.

The apparatus of this invention has been used successfully in cleaning shirt collars before the shirt is processed through the normal washing, drying and pressing cycles in a laundry. The air cylinder employed for cylinder 40 was one with 1.0625 inch diameter × 18-inch stroke Model No. MRS-0918-DXP under the tradename, Bimba. The spray nozzle (19 in the drawings) was identified as ¼ MEG flat spray No. 4003 made by Spraying Systems Co. of Wheaton, Ill. This spray had a spray angle of 40° and a capacity of 1.8 gal./min. The pump was a Cat Pump Model 2SF2OE rated at a discharge volume of 2 gal./min. at 1200 psi discharge pressure, 3450 rpm, with a plunger stroke of 0.122 inch. The cleaning solution used was a solution of one cup of commercial degreasing liquid detergent per eight gallons of water. Collars of various amounts of soiling were cleaned very well by one cycle of the nozzle spaced about two inches above the work plate 14.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. An apparatus for laundry spray cleaning comprising a housing containing a horizontally positioned open-top tub for containing a reservoir of cleaning liquid, a horizontal work table above said tub to support the item to be cleaned, a spray nozzle suspended closely above said work table and directed to spray said liquid downwardly against said item on the work table while moving in a horizontal reciprocating motion across said work table, a pump to receive said liquid from said tub, pressurize it and deliver, at a pressure of 500–2000 psig, the pressurized liquid to said nozzle, and means to selectively cause said spray nozzle to reciprocate.

2. The apparatus of claim 1 wherein said spray nozzle is moved in said reciprocating motion by the action of a piston in a cylinder of pressurized fluid.

3. The apparatus of claim 2 wherein said cylinder of pressurized fluid is a pneumatic cylinder.

4. The apparatus of claim 1 adapted to spray-clean shirt collars.

5. The apparatus of claim 2 wherein said reciprocating motion is provided by the combination of said spray nozzle being suspended rigidly and vertically from a block sliding horizontally in a track and with said block being fastened to said piston.

6. A shirt collar cleaning machine comprising a housing containing horizontally positioned, open-top, rectangular tub adapted to function as a reservoir for cleaning liquid, a work table adapted to support a shirt collar and positioned horizontally and overhanging a portion of said open-top, a spray pipe suspended vertically above said work table and terminated at its lower end by a spray nozzle pointing downwardly and positioned a few inches above said work table, a pump to provide liquid at a pressure of 800–1500 psig to said spray pipe and nozzle and having its suction inlet connected to said tub and its outlet connected to said spray pipe; a pressurized fluid cylinder with a piston rod extending outwardly of said cylinder and moving horizontally and reciprocatingly when said fluid is pressurized, sliding support means connected to said piston and to said spray nozzle pipe; and selective means to cause said piston to move horizontally and reciprocatingly.

7. The machine of claim 6 wherein said cylinder is a pneumatic cylinder.

8. The machine of claim 6 wherein said support means is a block sliding horizontally in a track.

9. The machine of claim 6 wherein said pump outlet and said spray nozzle pipe are connected by a flexible tubing suspended above said support means.

* * * * *